US010124477B2

(12) United States Patent
Henry

(10) Patent No.: US 10,124,477 B2
(45) Date of Patent: Nov. 13, 2018

(54) AIR CANNON

(71) Applicant: THE CANNON COMPANY, Sterling, CO (US)

(72) Inventor: William R Henry, Sterling, CO (US)

(73) Assignee: The Cannon Company LLC, Sterling, CO (US)

( * ) Notice: Subject to any disclaimer, the term of this patent is extended or adjusted under 35 U.S.C. 154(b) by 0 days.

(21) Appl. No.: 15/582,551

(22) Filed: Apr. 28, 2017

(65) Prior Publication Data

US 2018/0147710 A1 May 31, 2018

Related U.S. Application Data

(60) Provisional application No. 62/427,615, filed on Nov. 29, 2016.

(51) Int. Cl.

| | |
|---|---|
| ***B25D 9/08*** | (2006.01) |
| ***B25D 17/06*** | (2006.01) |
| ***B25D 17/28*** | (2006.01) |
| *E21B 43/12* | (2006.01) |

(52) U.S. Cl.

CPC ..... *B25D 9/08* (2013.01); *B25D 17/06* (2013.01); *B25D 17/28* (2013.01); *B25D 2217/0023* (2013.01); *B25D 2250/005* (2013.01); *E21B 43/127* (2013.01)

(58) Field of Classification Search

CPC ..... B25D 9/08; B25D 17/06; B25D 17/28; B25D 2217/0023; B25D 2250/005; E21B 43/127

USPC ..... 173/206, 91

See application file for complete search history.

(56) References Cited

U.S. PATENT DOCUMENTS

| | | | | |
|---|---|---|---|---|
| 1,459,402 | A * | 6/1923 | Johnson | B25B 21/023 173/108 |
| 3,266,581 | A * | 8/1966 | Cooley | B25D 9/08 173/137 |
| 6,655,224 | B1 * | 12/2003 | Ji | F04B 47/022 417/328 |
| 6,904,980 | B2 * | 6/2005 | Rubie | B25B 27/02 173/128 |
| 7,607,491 | B2 * | 10/2009 | Sorric | B25D 17/30 173/169 |

(Continued)

OTHER PUBLICATIONS

American International Manufacturing Corp., Fort Worth, TX Prior filed brochure on Wrist Pin Knocker (4pages) dated Jan. 5, 1992.

*Primary Examiner* — Andrew M Tecco

(74) *Attorney, Agent, or Firm* — Craig R. Miles; CR Miles P.C.

(57) ABSTRACT

A prior art powered wrist pin knocker is imported with a new plunger that prevents wobbling. The new plunger responds to a return vacuum pressure. The improved plunger is symmetrical along a longitudinal axis. New embodiments include a new side mount valve head to reduce length, a remote air controller and a variable length cylinder for the cannon. The new valve head is a simplified valve head assembly that adapts to an end of the cannon mount or a side mount or a remote mount. Another embodiment provides a stand for a surface mount application. This embodiment can have an extended piston for loosening tail bearings down a long channel. A manual return embodiment can use a rod to manually return the plunger to the proximal end for another firing cycle.

24 Claims, 21 Drawing Sheets

(56) References Cited

U.S. PATENT DOCUMENTS

| | | | | |
|---|---|---|---|---|
| 7,681,658 | B2 * | 3/2010 | Duval | B25D 9/04 173/1 |
| 2004/0140113 | A1 * | 7/2004 | Rubie | B25B 27/02 173/206 |
| 2007/0215368 | A1 * | 9/2007 | Sorric | B25D 17/30 173/31 |

* cited by examiner

AIR CANNON

CROSS REFERENCE APPLICATIONS

This application is a non-provisional application claiming the benefits of provisional application No. 62/427,615 filed Nov. 29, 2016

FIELD OF INVENTION

The present invention relates to using compressed air to fire a cylindrical projectile (about a foot or more in length) down a tube so as to dislodge a wrist pin or similar pin stuck in a pivot point hole, especially in an oil pump.

BACKGROUND OF THE INVENTION

Oil pumping rigs such as disclosed in U.S. Pat. No. 6,655,224 (2003) to Ji et al. have a wrist pin-shown in FIG. 1 as prior art. These pins wear out and must periodically be replaced. Usually the crank arm is removed from the rig for this operation. Historically a twenty-pound sledge hammer is manually swung against the old stuck wrist pin.

Known in the art is a black powder cannon that may be used to unseat a wrist pin in place on the rig, which may present risks to the worker.

The closest prior art known is shown in FIGS. 2, 3, 4 and 6. An American International Manufacturing Corporation Wrist Pin Knocker is shown. The parts list follows below:

| Item | Qty | Description | Part No. |
|---|---|---|---|
| 1 | 1 | Cylinder | 70362 |
| 2 | 1 | Warning Decal | 70077 |
| 3 | 1 | Swivel Nut | 70401 |
| 4 | 1 | Cylinder Head | 64317 |
| 5 | 1 | Aspirator Body | 64319 |
| 6A | 1 | Hammer used as valve handle | 64411 |
| 6B | 1 | Hammer | |
| 7 | 1 | Aspirator Nozzle | 64320 |
| 8 | 1 | Valve Guard | 64318 |
| 9 | | Not Used | |
| 10 | 1 | Valve Body | 64415 |
| 11 | 1 | Pipe Union .75" NPT | 64387 |
| 12 | 1 | Hose Nipple .75" NPT | 64383 |
| 13 | 1 | Adapter 3"- 6 Thd & 3"-8 Thd | 69975 |
| 14 | 1 | Hose Clamp No. 104 | 64368 |
| 15 | 1 | Outer Filter Retainer | 64360 |
| 16 | 4 | Hex, Sckt, Screw 3.21 × 1.75 | 64379 |
| 17 | 1 | Pipe Plug .50 | 70370 |
| 18 | 4 | Nylock, Hex Nut, 5/16-18 unc | 64366 |

The swivel nut 3 is screwed onto an adapter that is screwed onto an end of the stuck wrist pin. The wrist pin knocker is ready when the piston P is set at the swivel nut end. Then the 100 to 125 PSI air hose is connected to the hose nipple 12. Next a control handle 6A (also used as a hammer) is set to the return position→to draw via suction the piston P to the valve guard 8 end. Next the handle is set to the neutral N position. Next the handle is quickly moved to the forward position←which causes the piston P to hit the stuck wrist pin. This operation is repeated until the wrist pin is loosened. The hammer 6A can function as the handle H.

In practice with the one old unit on hand the return function did not work. Instead the swivel nut 3 had to be unscrewed, and the piston P had to be shoved with a stick up to the valve guard 8 end. The cylinder head 4 has a valving assembly that passes compressed air out the aspirator nozzle 7 via a narrow tube 5 in FIG. 2, thereby causing vacuum pressure at the valve guard 8 end for return of the piston P.

Air holes in the outer filter retainer 15 in theory allow the piston P to be pulled by vacuum to the valve guard 8 end.

What is needed in the art is an improved piston design that enables the return function as noted above. Further needs are to protect the striking end of the piston P from destroying the inside of the cylinder 1 due to the wobbling of the heavy (twelve pound) steel piston in the aluminum cylinder. Another need is to protect the sliding collars on the piston from wear and tear.

Other needs may include shortening the length of the cannon as well as improving safety by moving the operator away from the cannon as well as providing an adjustable length cannon.

The present invention meets all these needs with an improved piston, a simpler valve assembly, a remote controller, a repositioned controller, and a modular cylindrical shaft.

SUMMARY OF THE INVENTION

The main aspect of the present invention is to provide an improved piston on a wrist pin knocker air cannon.

Another aspect of the present invention is to provide a simple valve assembly having minimal parts.

Another aspect of the present invention is to provide a remote control embodiment for a wrist pin knocker air cannon.

Another aspect of the present invention is to provide a modular length embodiment for a wrist pin knocker air cannon.

Another aspect of the present invention is to provide a shortened embodiment of the wrist pin knocker air cannon with a side mounted valve assembly.

Another aspect of the present invention is to provide a simple change kit to go from a side mount valve assembly to a remote control valve assembly.

Another aspect of the present invention is to provide a universal stand for deck mounting the air cannon.

Another aspect of the present invention is to provide an extension kit to drive a stuck shaft all the way out a long channel.

Other aspects of this invention will appear from the following description and appended claims, reference being made to the accompanying drawings forming a part of this specification wherein like reference characters designate corresponding parts in the several views.

Before explaining the disclosed embodiments in detail, it is to be understood that the embodiments are not limited in application to the details of the particular arrangements shown, since other embodiments are possible. Also, the terminology used herein is for the purpose of description and not of limitation.

DETAILED DESCRIPTION OF THE DRAWINGS

Figure 1:
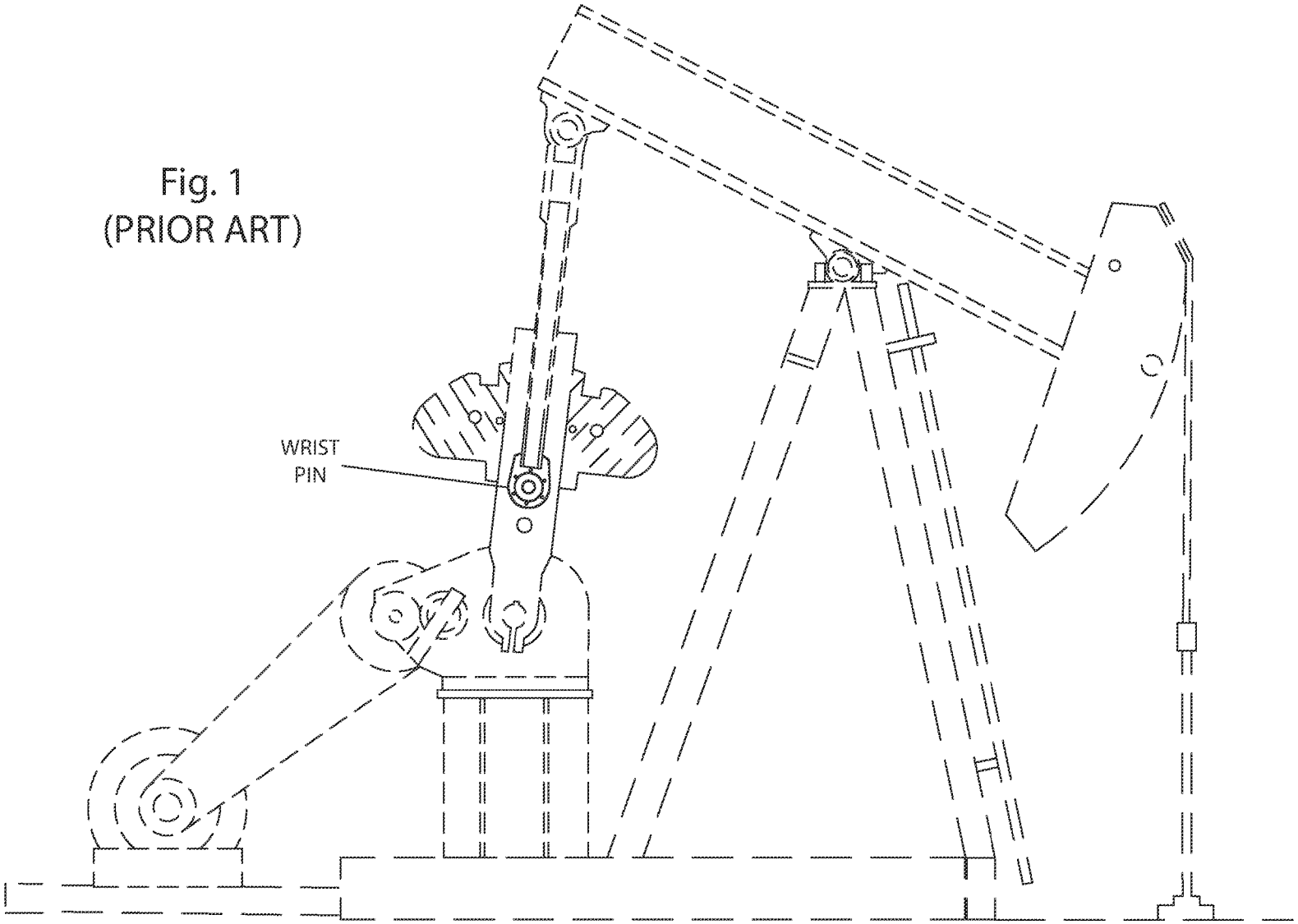
Fig. 1 (PRIOR ART)
FIG. 1 (prior art) is a side elevation view of an oil pump.

Referring next to FIGS. 2, 3, 4 and 6 the original plunger hammer P shown had two problems. First it wobbled and chewed up the aluminum air cannon 1 shown in FIG. 6 at the impact end 60. The air exhaust ports 61 are shown which vent into the air exhaust muffler (labeled the outer filter retainer 15 in FIG. 1). A plunger hammer snap ring 62 is shown removed from the air cannon in FIG. 6. Dimension d13 is 25.25 inch. The control valve end is designated 109.

The second problem was it did not return via vacuum pressure to the valve body 109 end when the handle H was moved to the return position. The device was designed to use the air pressure from inlet 12 to exhaust from the nozzle 7, thereby creating a vacuum at the valve body 109 end. The original plunger hammer P weighed 12.54 lb. made of steel. Nylon bearings 40, 41 were supposed to stop wobbling and reduce friction. They did not work. Nominal dimensions are d1=6.00 inch, d2=1.00 inch, d3=3.38 inch, d4=3.53 inch, d5=2.63 inch, d6=4.02 inch, d7=0.89 inch. Snap rings 43, 44 hold the bearings 40, 41 (nylon UHMW) in place.

Referring next to FIGS. 5A, 5B, 5C, 5D, 5E a new, improved plunger hammer 50 is shown. It weighs 14.94 lbs. made of steel. Nominal dimensions are d8=3.50 inch, d9=3.00 inch, d10=0.25 inch, d11=0.75 inch, d12=0.74 inch.

Figure 5A:
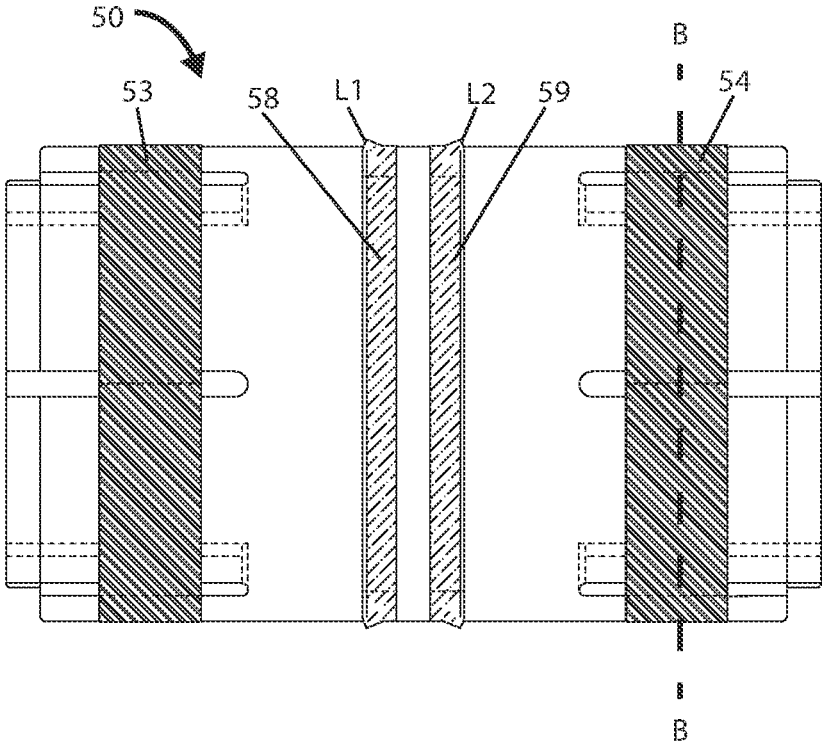
FIG. 5*a* is a side elevation view of the new plunger hammer.
Figure 5B:
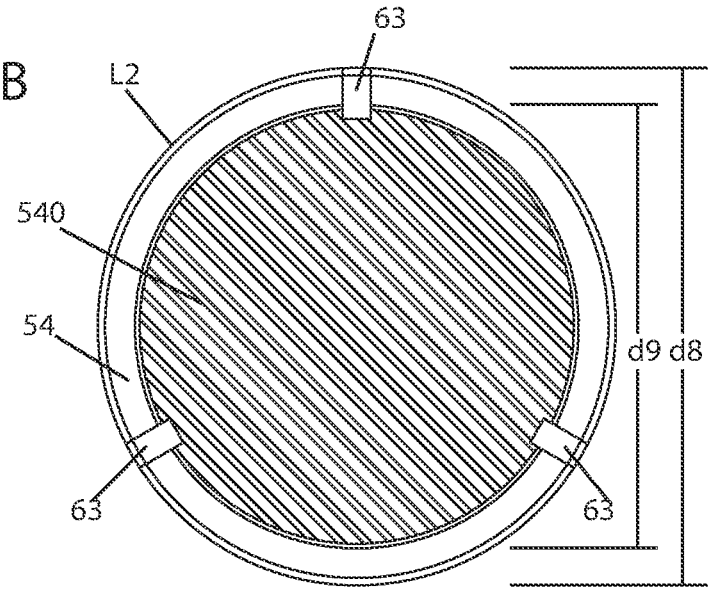
FIG. 5*b* is a cross sectional view of the plunger hammer taken along line B-B of FIG. 5*a*.
Figure 5C:
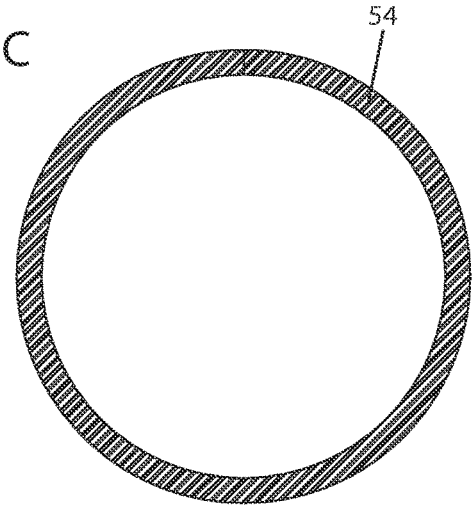
FIG. 5*c* is a cross sectional view of the bearing 54 of FIG. 5*a*.
Figure 5D:
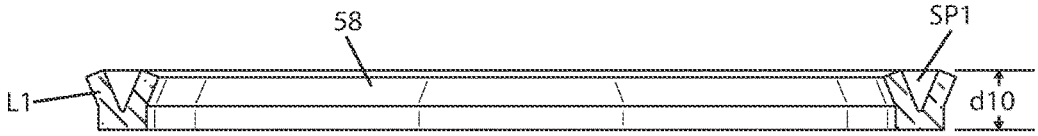
FIG. 5*d* is a close up side elevation view of the rubber rings 58, 59 of FIG. 5*a*.
Figure 5E:
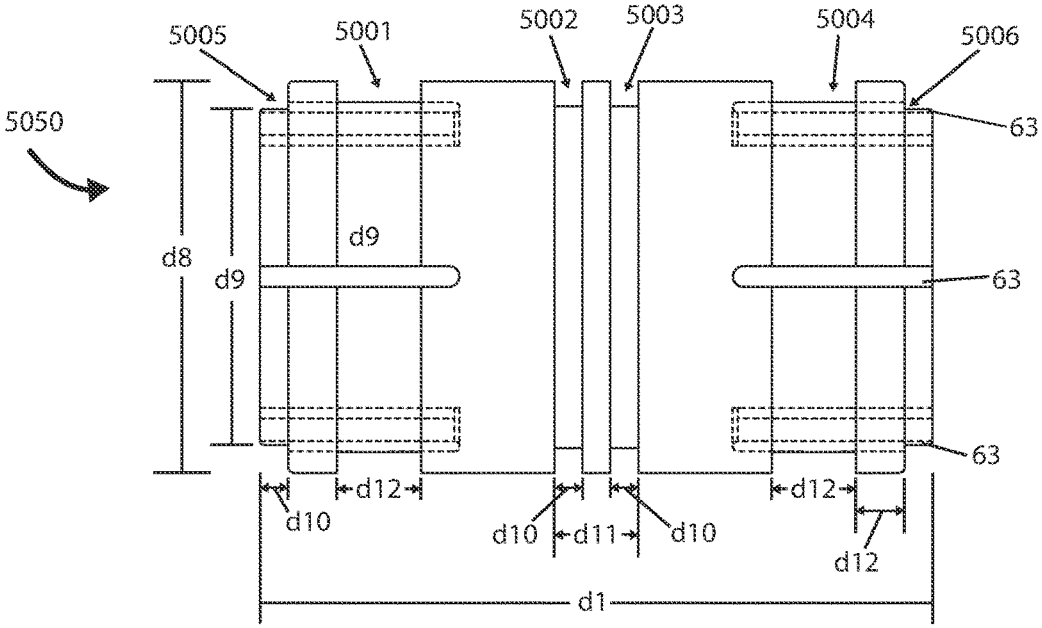
FIG. 5*e* is an exploded view of the plunger hammer 50 of FIG. 5*a*.
Figure 6:
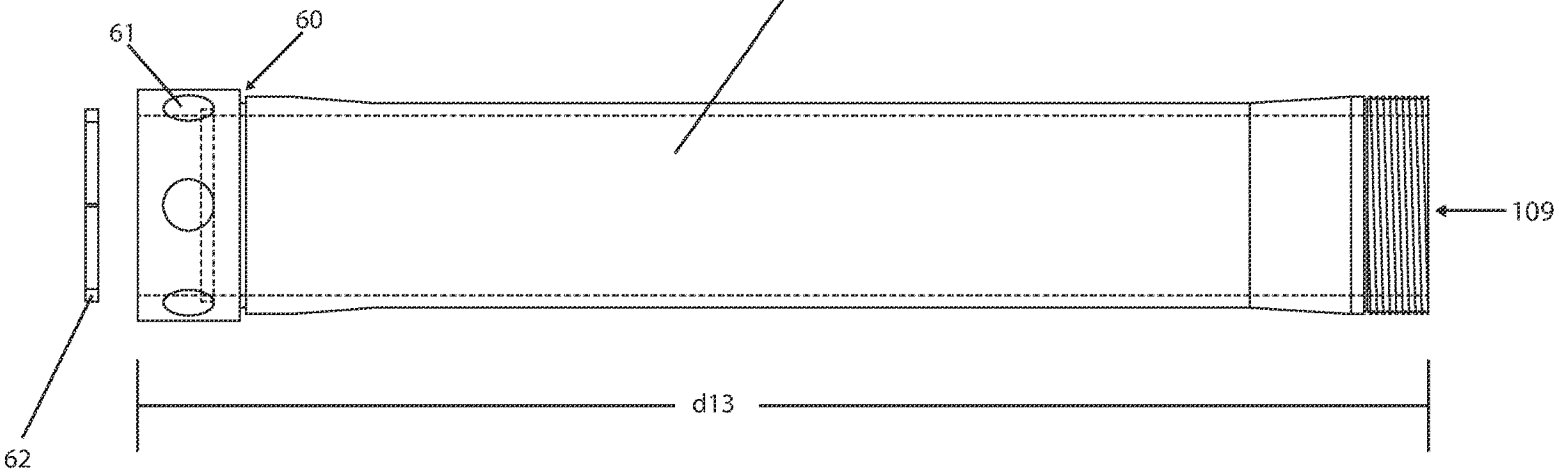
Fig. 6 (PRIOR ART)
FIG. 6 (prior art) is an exploded view of the air cannon barrel shown in FIG. 2.

It does not wobble, and it returns to the valve body end 109 under vacuum. Air exhaust relief ports 63 allow a certain amount of air to blow by the plunger hammer 50. Bearings 53, 54 (nylatron NSM) slide along the inside of air cannon 1. In FIG. 5A rubber rings 58, 59 have lips L1, L2 that extend above the surface SUR1 of the piston. Lip L1 expands outbound as the plunger hammer 50 moves in the activate direction. Lip L2 expands outbound when the plunger hammer moves in the retract direction. A space SP1 shown in FIG. 5D is created as a lip expands outbound. The end of the plunger hammer is labeled 540. The plunger hammer 50 is symmetrical. In FIG. 5E the steel piston 5050, has shoulders 5005, 5006 narrowing the outside diameter about 0.25 inch to surface 540. Groove 5001 houses bearing 53. Groove 5004 houses bearing 54. Groove 5002 houses o-ring 58.

Figure 7A:
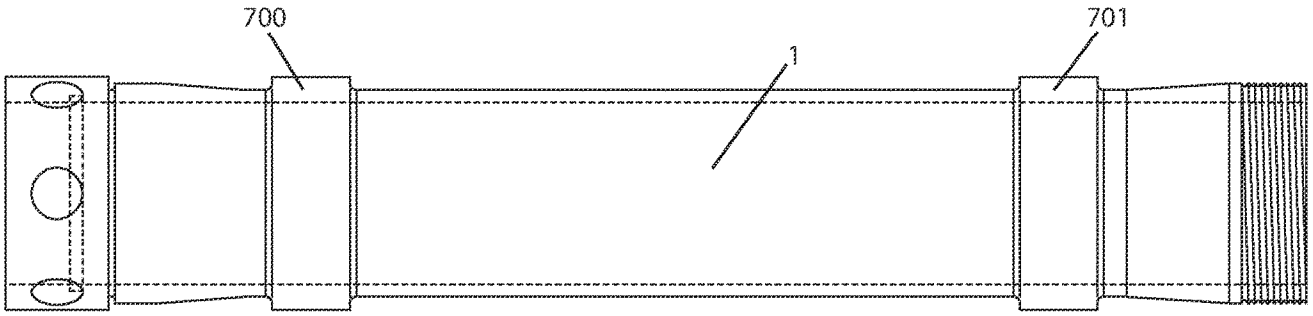
FIG. 7*a* (prior art) is a side elevation view of an air cannon.
Figure 7B:
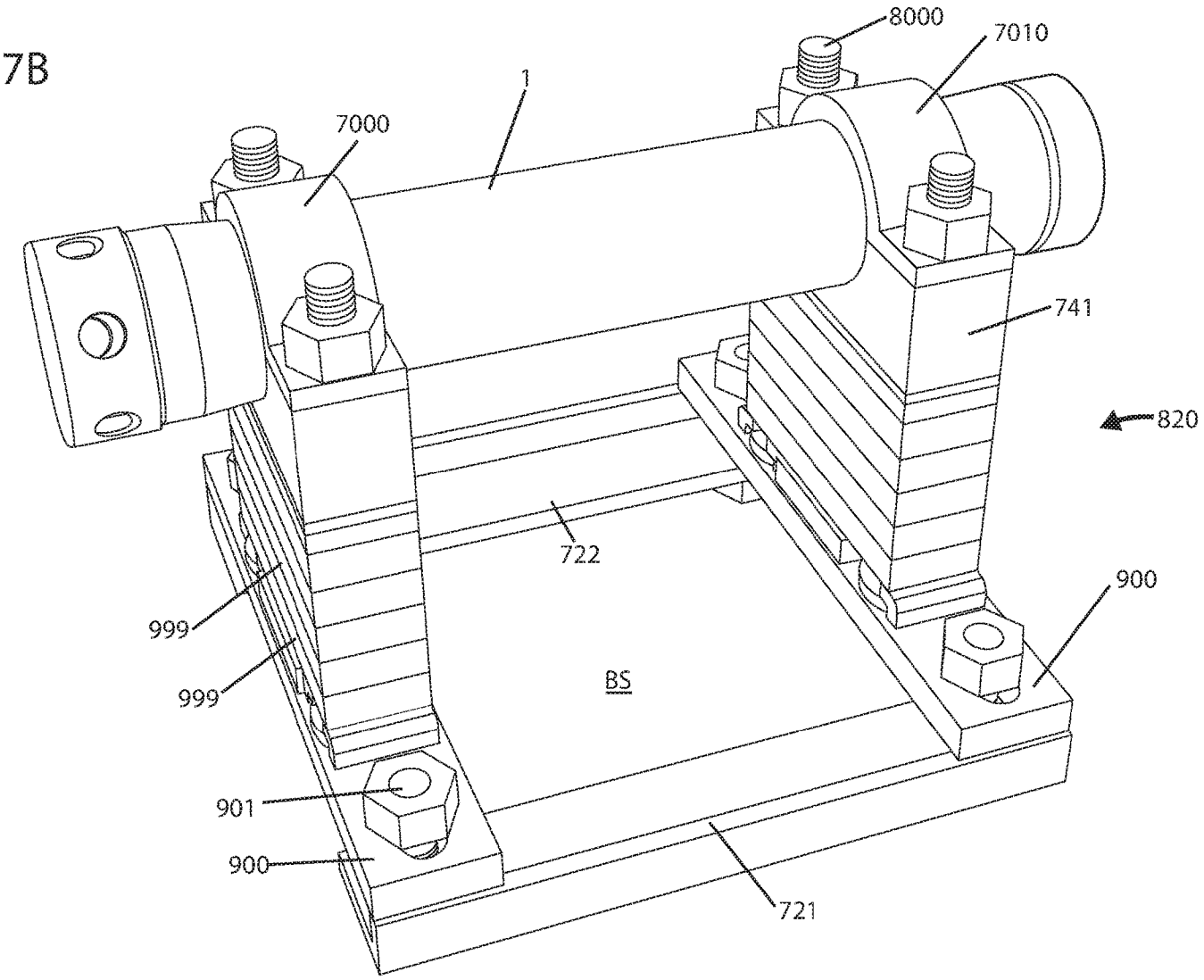
FIG. 7*b* is a top perspective view of a shimmed stand for the air cannon.

Referring next FIGS. 7A, 7B an air cannon 1 may need to be mounted to a base surface BS in order to strike an adjacent wrist pin or tail bearing (not shown). The air cannon 1 must have protective flanges 700, 701. A concave brace 7000 encases flange 700 via bolts 8000. A concave brace 7010 encases flange 701 via bolts 8000.

Stand 820 has feet 721, 722 with crossbars 900 having a bolt 901 connection to feet 721, 722. Shims 999 are stacked to achieve a height and level for air cannon 1. The floating bridges 741 have a concave indent for flanges 700, 701. Bolts 8000 secure the shims 999 at a desired height.

Figure 2:
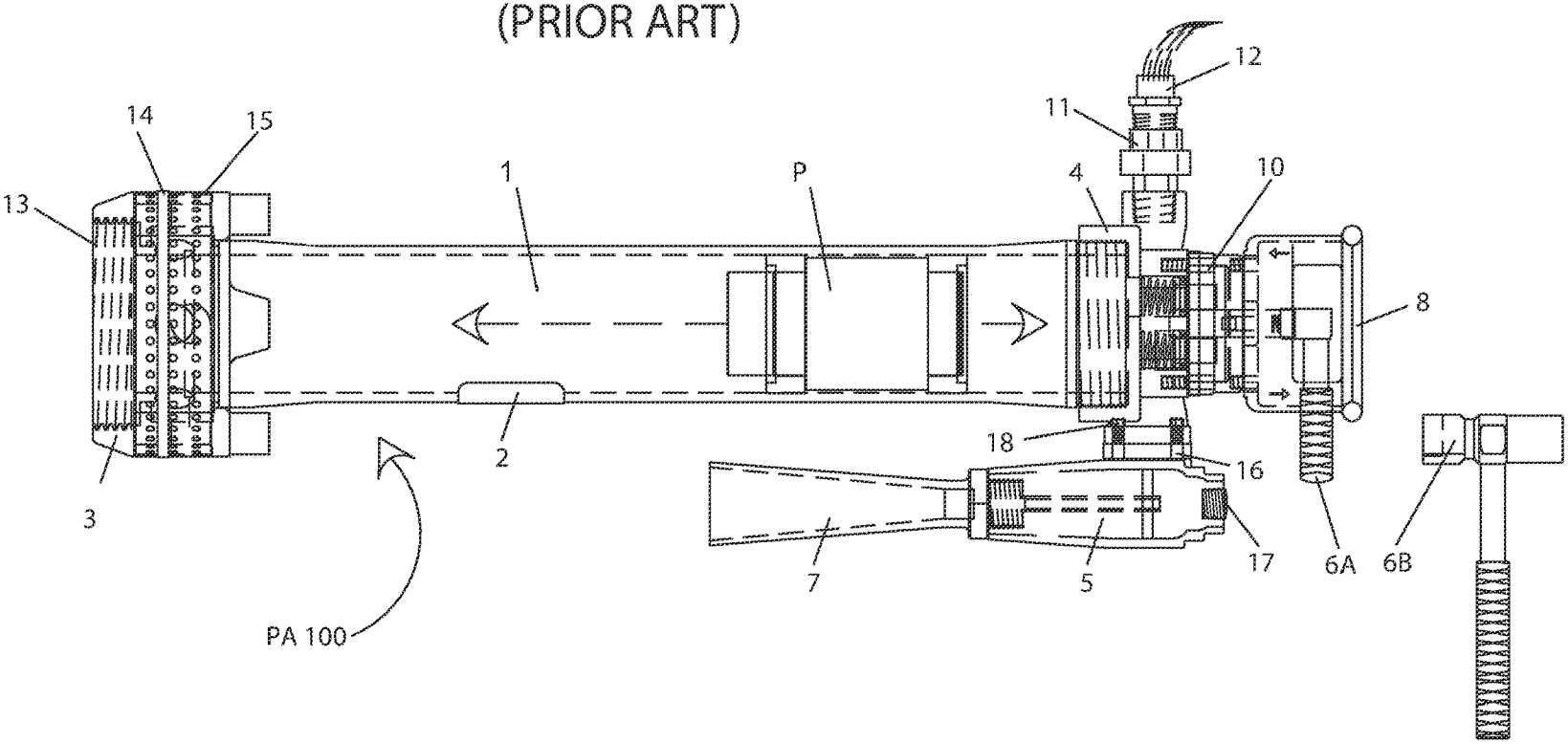
Fig. 2 (PRIOR ART)
FIG. 2 (prior art) is a side elevation view of a wrist pin knocker.
Figure 3:
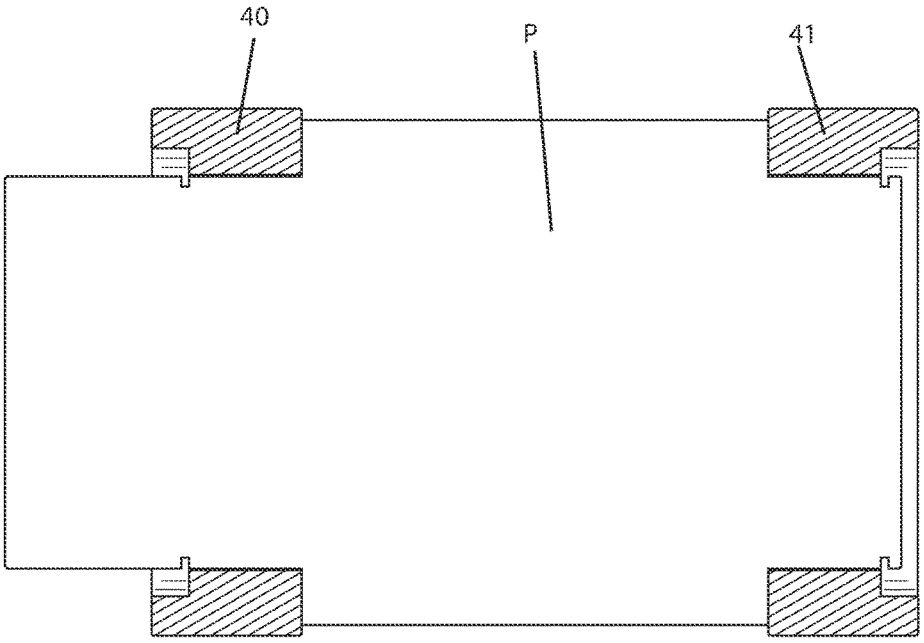
Fig. 3 (PRIOR ART)
FIG. 3 (prior art) is a side elevation view of the original plunger hammer for the wrist pin knocker in FIG. 2.
Figure 4:
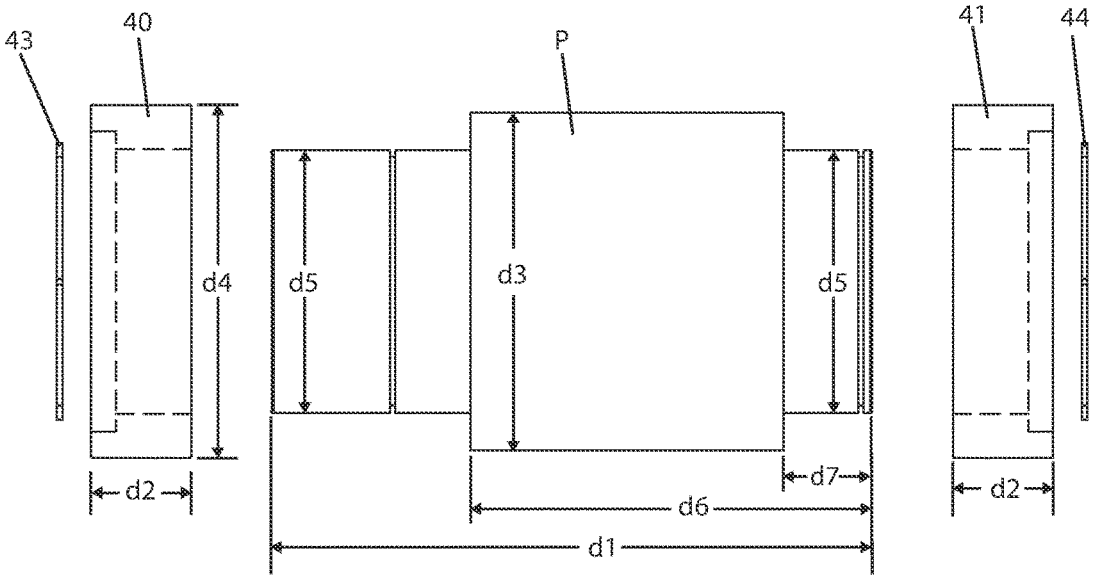
Fig. 4 (PRIOR ART)
FIG. 4 is an exploded view of the plunger hammer shown in FIG. 3.
Figure 8A:
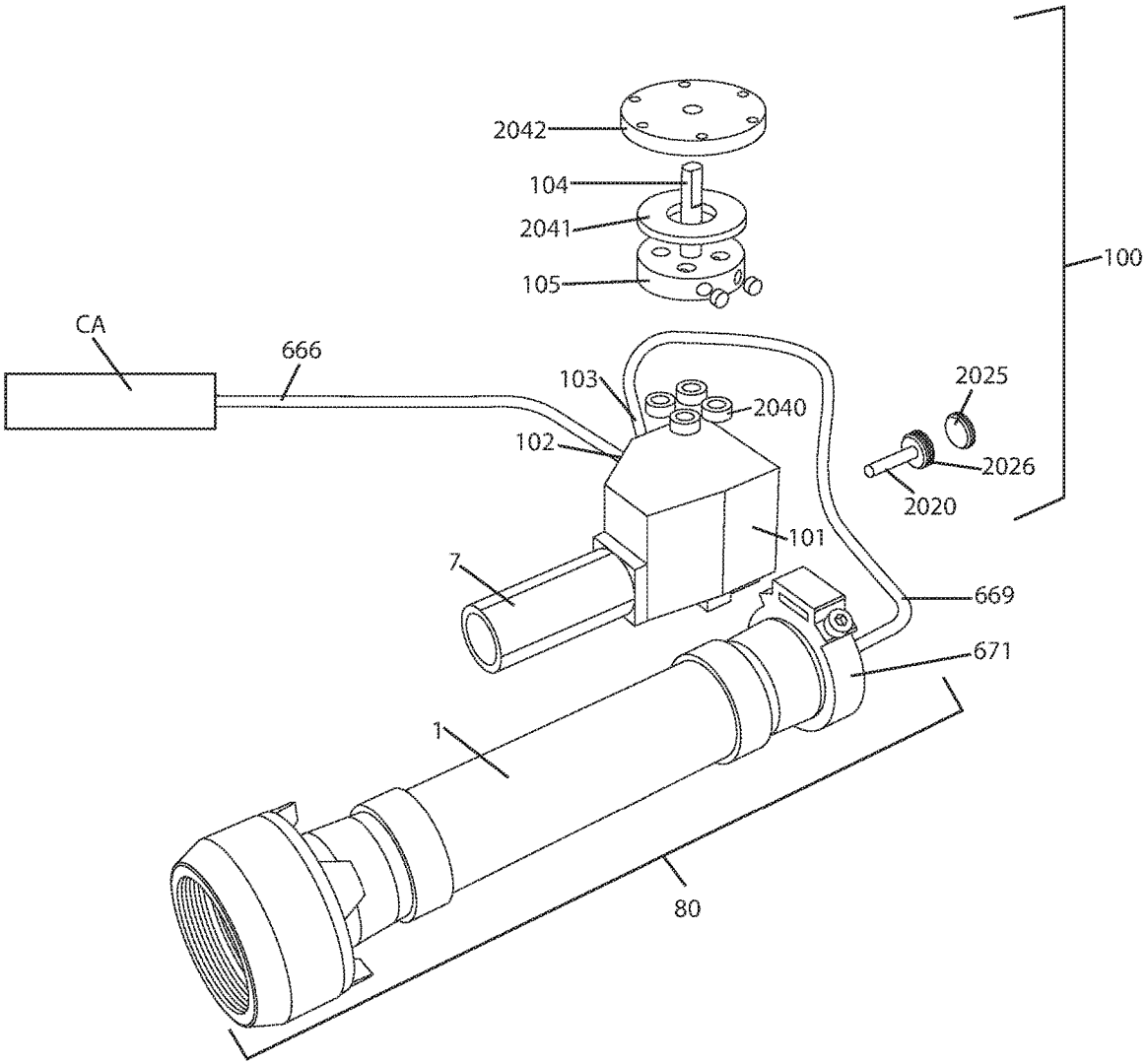
FIG. 8*a* is an exploded view of a side mount valve assembly.
Figure 8B:
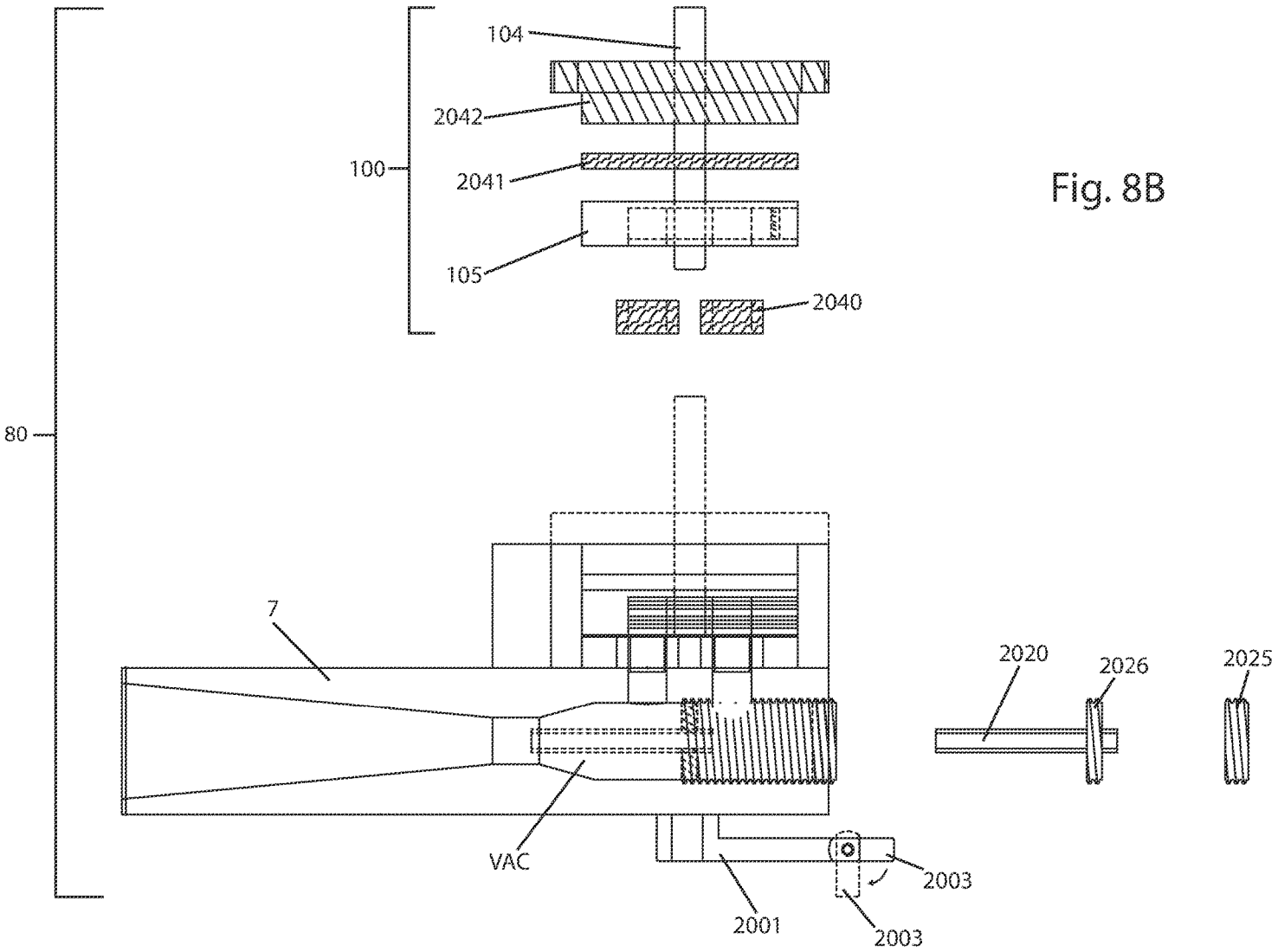
FIG. 8*b* is an exploded view of the side mount valve assembly.
Figure 8C:
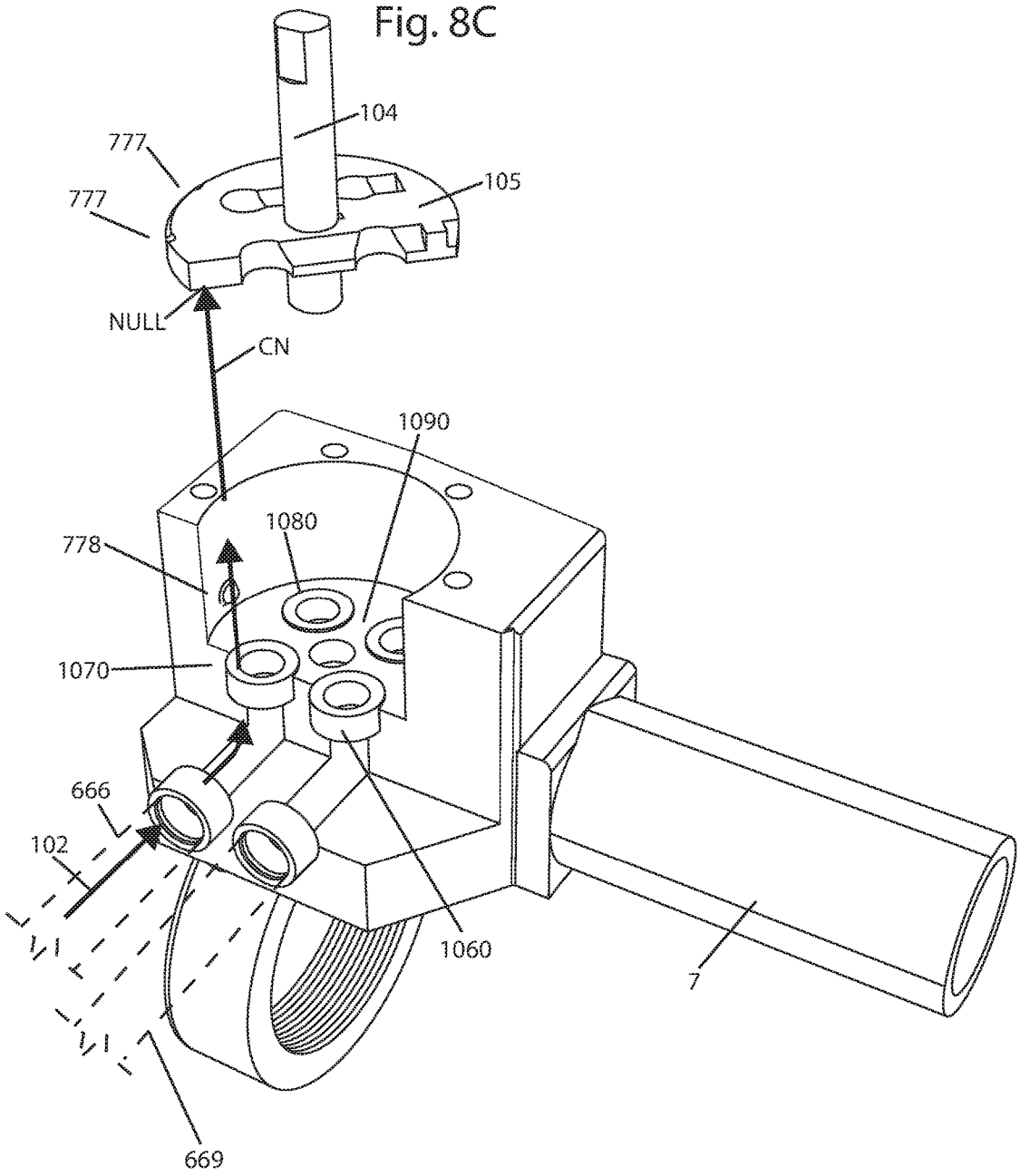
FIG. 8*c* is a top cutaway view of the side mount valve assembly in the neutral position.

Referring next to FIGS. 8A-8I a side mounted air cannon and valve assembly 80 shortens the longitudinal length d13 to about 25 inches. This is about six inches shorter than the prior art air cannon 1 shown in FIG. 2. The valve assembly is designated 100. The aspirator is designated 101. It has a compressed air inlet 102. A pressurized air PI or vacuum air VAC outlet is designated 103. This outlet 103 from the aspirator 101 is connected by hose 669 to hole 670 in the end cap 671. Compressed air CA is fed by hose 666 to aspirator inlet 102. Channel 790 connects the inlet 102 through the aspirator 101. A rotatable shaft 104 is manually turned nominally by a handle 6 as shown in FIG. 2. The rotatable shaft 104 turns the rotatory plate 105 that has channels 106, 107, 108, 109. Channel 106 is connected to channel 109 via hole CH2. Channel 107 is connected to channel 108 via hole CH1. These channels align with aspirator ports 1060, 1070, 1080, 1090 to provide three modes of operation. FIG. 8C shows a null alignment between any channels or ports. The air inlet 102 dead ends at point NULL. This defines the neutral mode. A pin 778 enters the detent 777 to define the neutral position. Arrows CN show the compressed air in path.

Figure 8D:
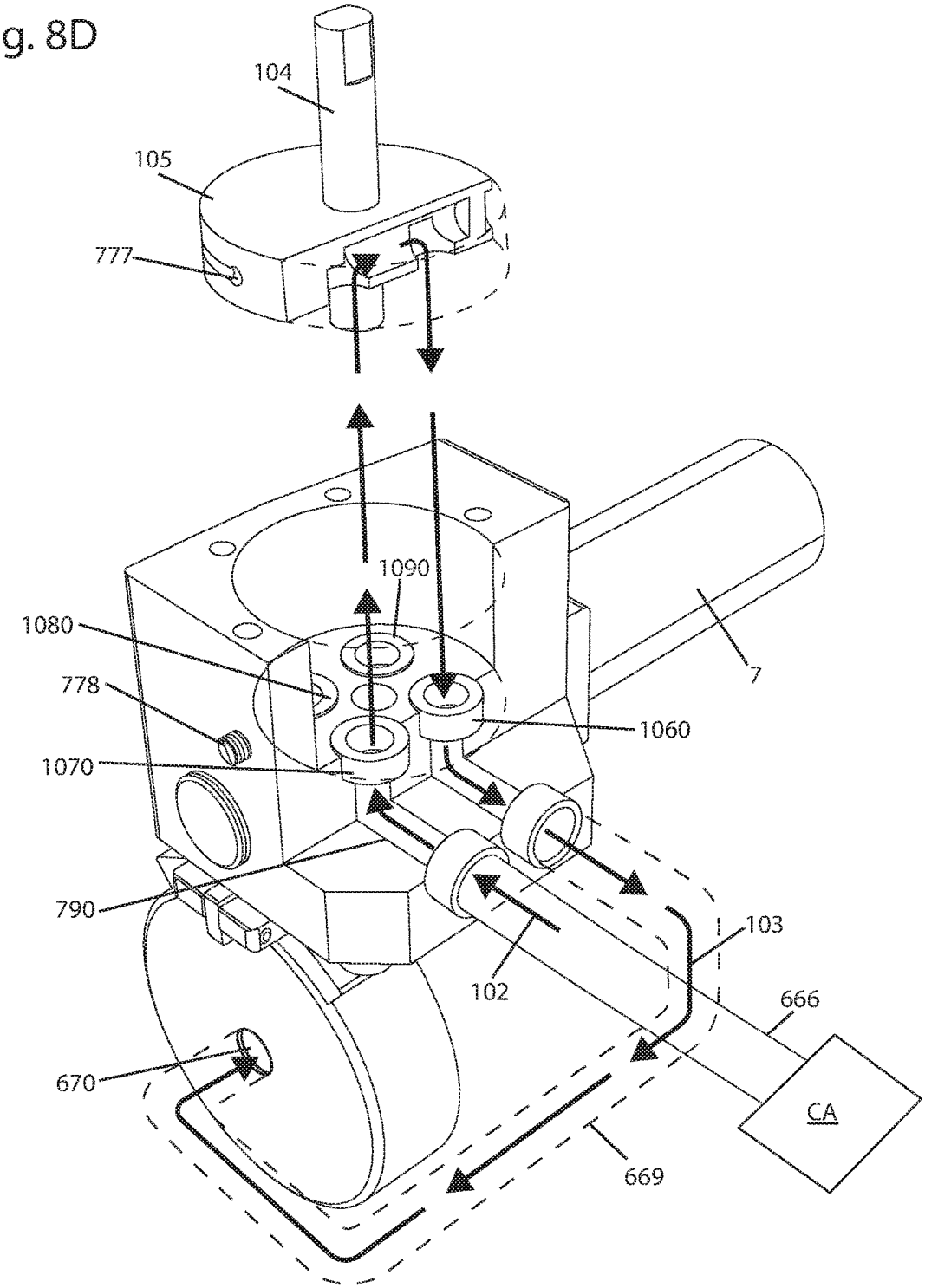
FIG. 8*d* is a top cutaway view of the side mount valve assembly in the activate plunger position.

FIG. 8D shows the activate plunger mode. Channel 106 aligns with aspirator port 1060, and channel 109 aligns with aspirator port 1090. The compressed air is ported into the valve end 109 (see FIG. 8G) thereby driving the plunger P down the air cannon 1. FIG. 8G shows the valve to barrel locking peg 2001 with swivel pin 2003 that locks the end cap 671 to the aspirator 101, after the end cap 671 is screwed tight to the air cannon 1. Bolts 872 secure the locking anchor 2007 end cap 671.

Figure 8E:
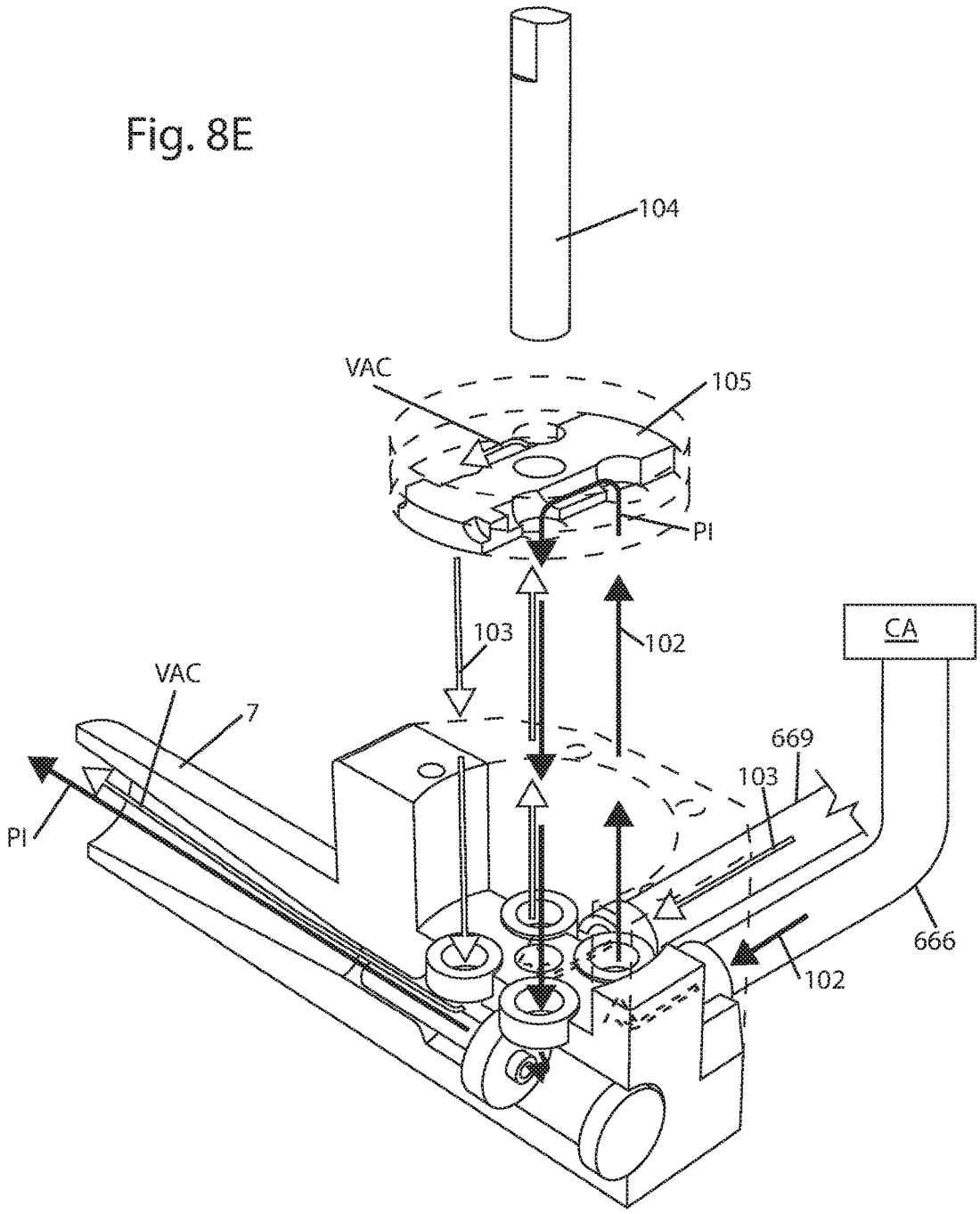
FIG. 8*e* is a top cutaway view of the side mount valve assembly in the retract plunger position.
Figure 8F:
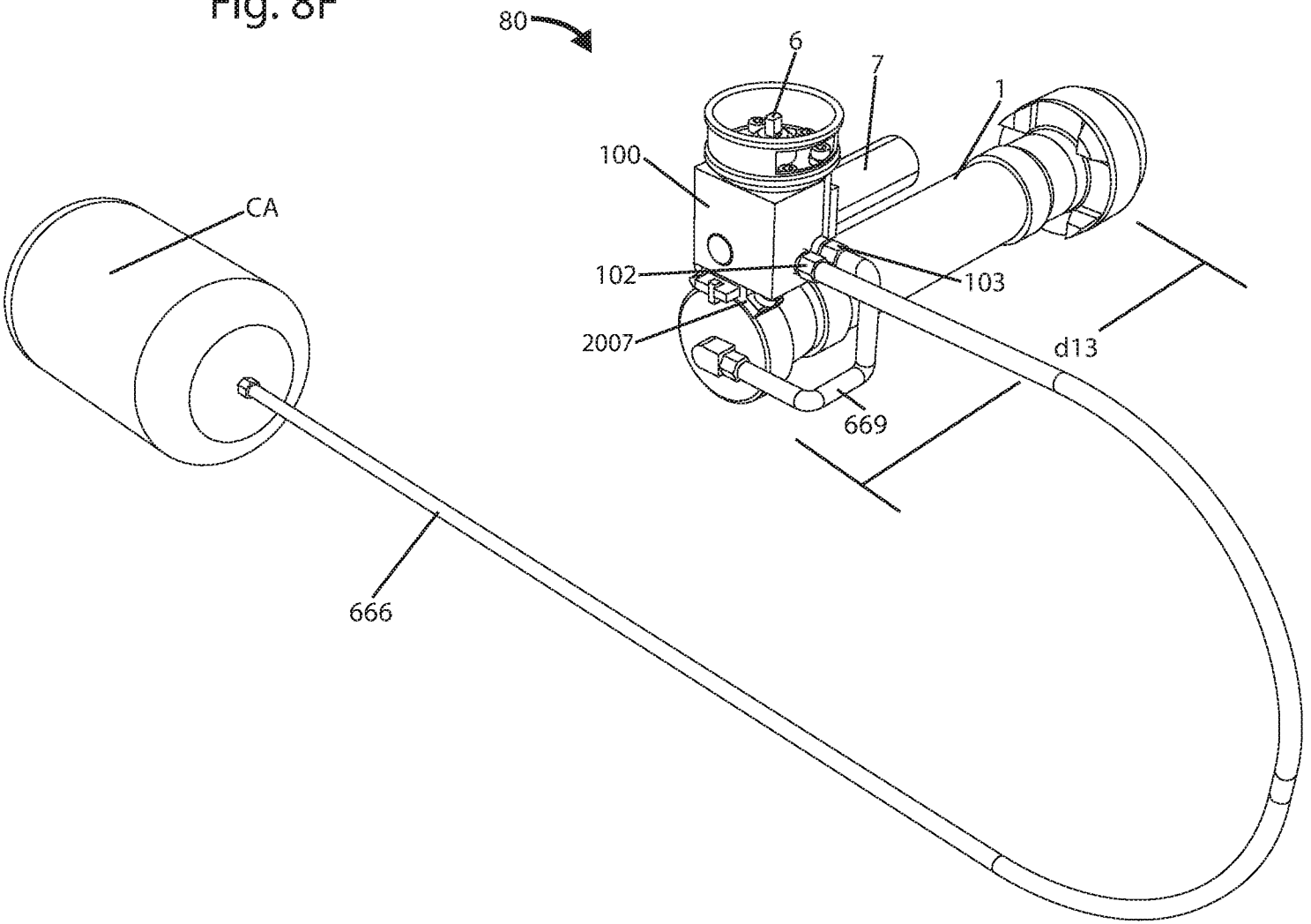
FIG. 8*f* is a top perspective view of the side mount air cannon.
Figure 8G:
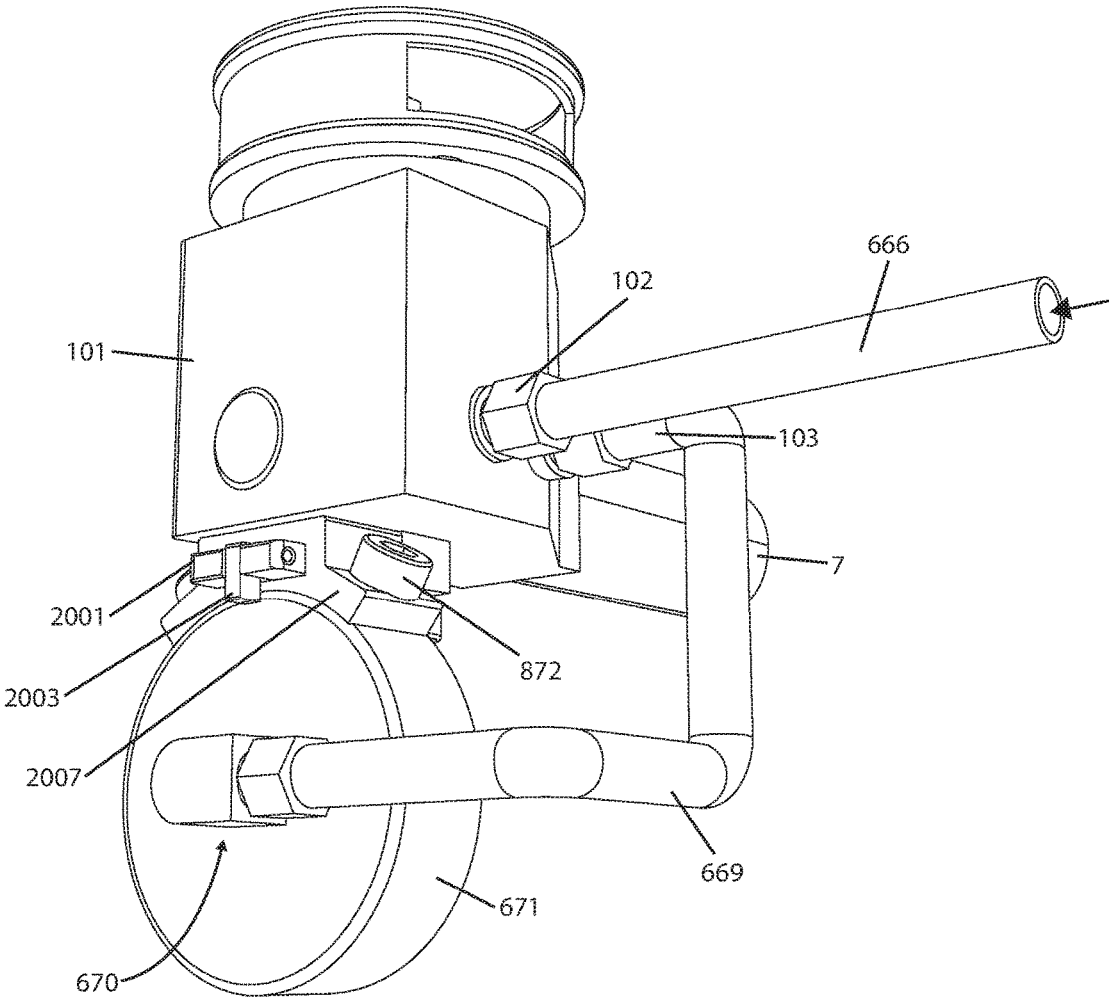
FIG. 8*g* is a rear perspective view of the side mount valve assembly.
Figure 8H:
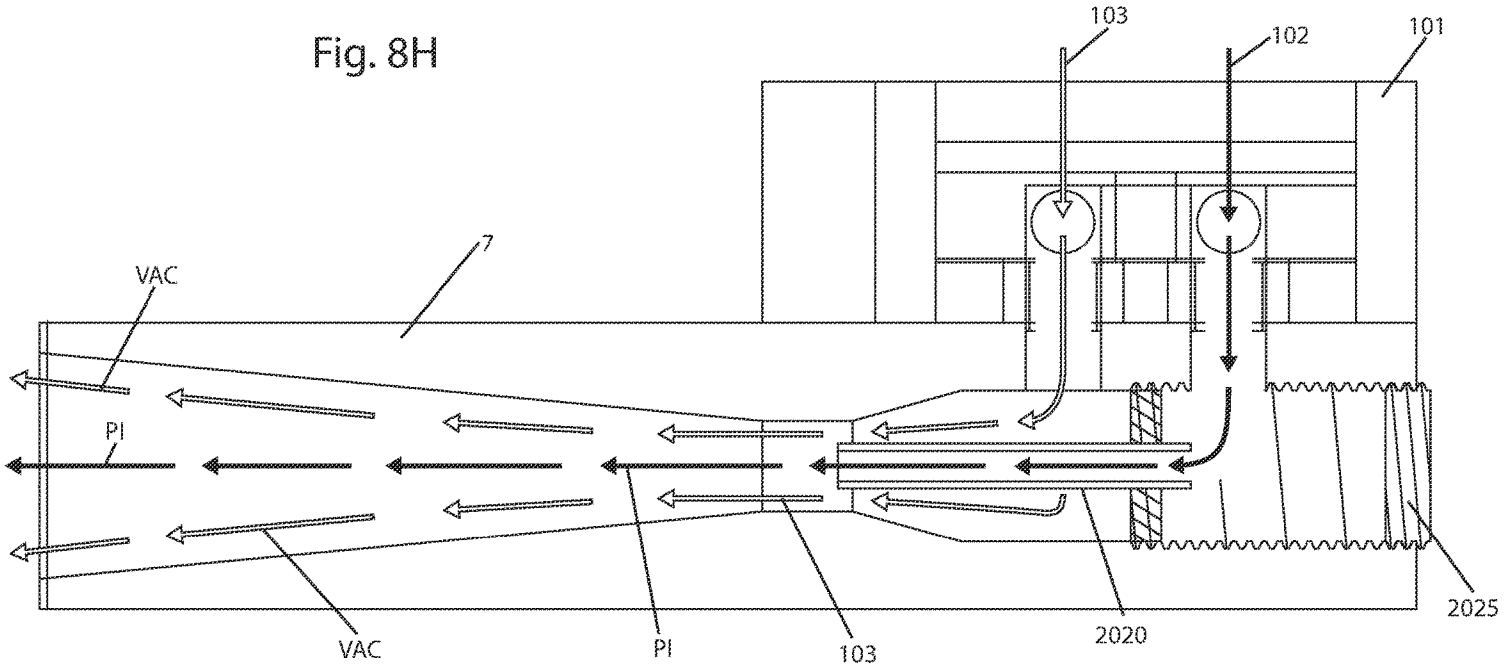
FIG. 8*h* is a schematic view of the vacuum generator.
Figure 8I:
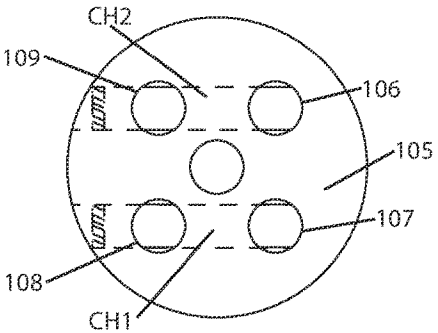
FIG. 8*i* is a top plan view of the valve head.

FIGS. 8B and 8E and 8H show how the compressed air PI is jetted across a proximal end 2021 of a vortex tube 2020, thereby creating a vacuum at the base VAC of the aspirator nozzle 7. This vacuum is transmitted out the outlet 103 via hose 669 to hole 670 and retracts the plunger 50 back to the valve end 109. An end plug 2025 holds the vortex tube 2020 in place. Nylon seals 2040 allow movement of the rotary plate without air leakage. A (nylon) bearing 2041 is held in place by a top cap 2042.

Figure 9:
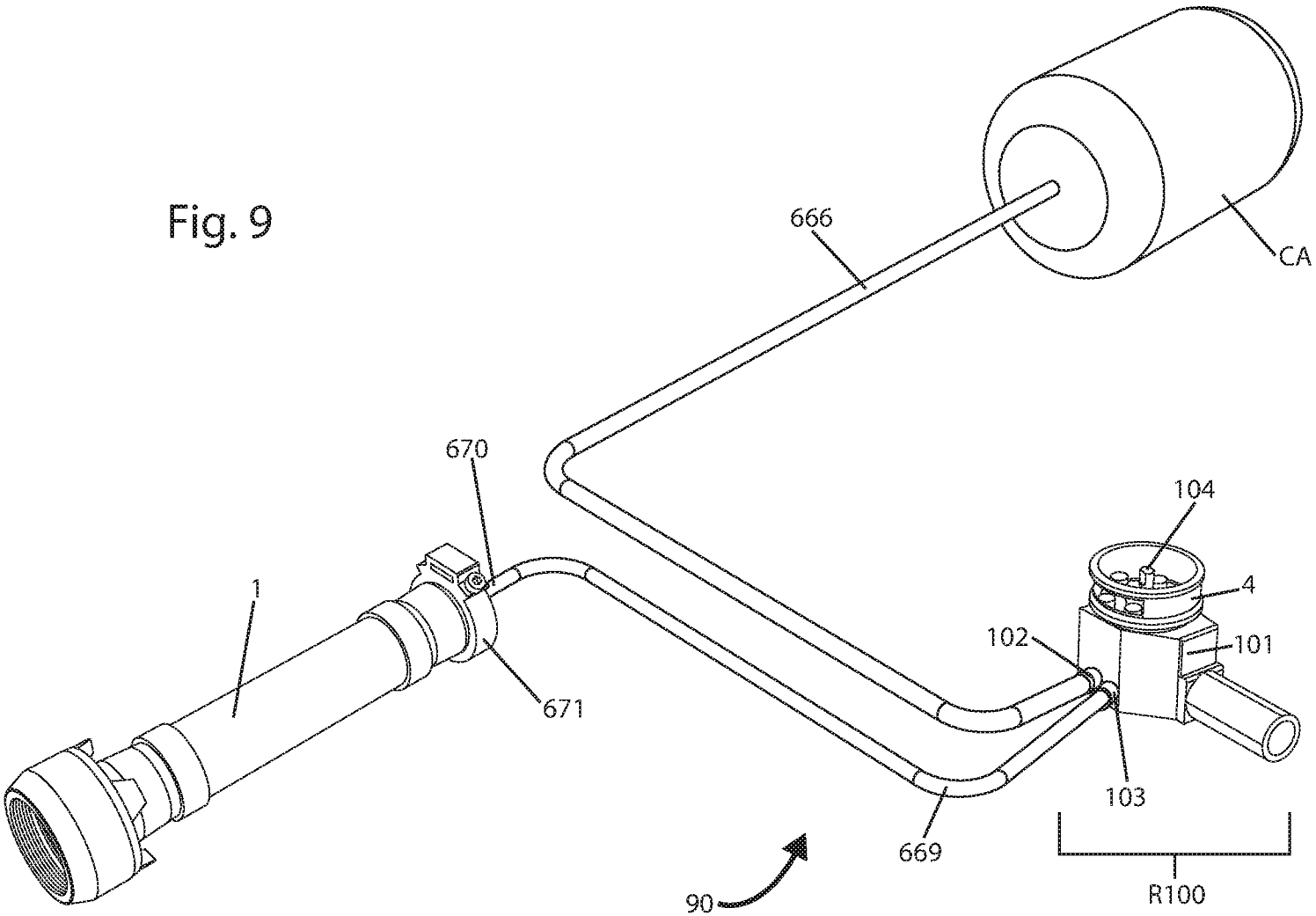
FIG. 9 is a top perspective view of a remote control embodiment.

Referring next to FIG. 9 a remote control cannon 90 taps an air hose 666 from the air supply CA into the aspirator 101 via inlet 102. The controller R100 has all the same features as the embodiment shown in FIGS. 8A-8I. The outlet hose 669 supplies either the activate pressure or retract vacuum to hole 670 shown in FIG. 8G. Easy conversion from a side mount to a remote mount controller is done by releasing the swivel pin 2003.

Figure 10A:
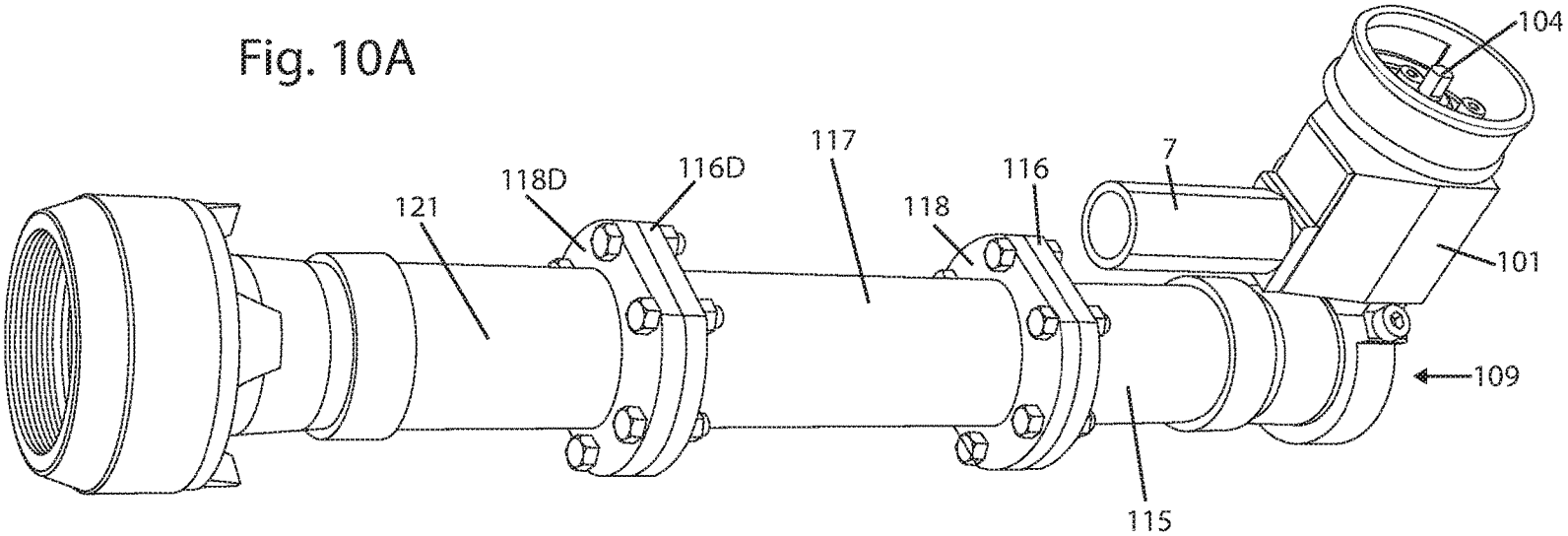
FIG. 10A is a top perspective view of an adjustable length air cannon embodiment.
Figure 10B:
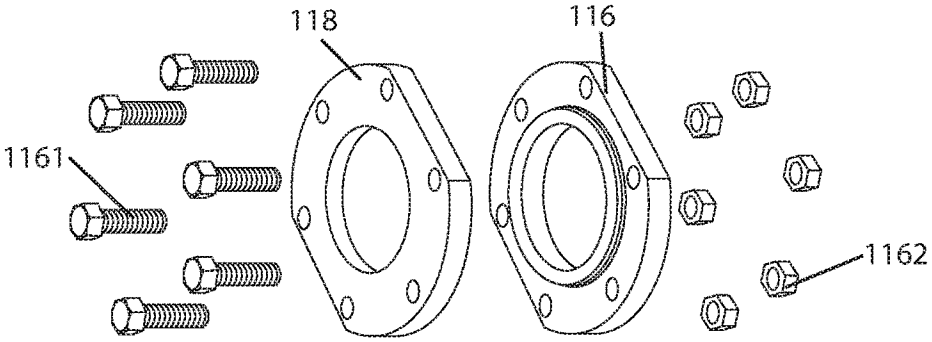
FIG. 10B is an exploded view of the mating flanges shown in FIG. 10A.

Referring next to FIG. 10A, 10B the cannon 1 is replaced with the valve end segment 115 that has a flange 116. An extended cylinder 117 has a flange 118 mating with flange 116. The distal end of extended cylinder 117 has a flange 116D that mates with flange 118D of distal extender 121. Bolts 1161 and nuts 1162 hold all flanges together. For a short air cannon distal extender 121 can connect directly to valve end segment 115.

Figure 11A:
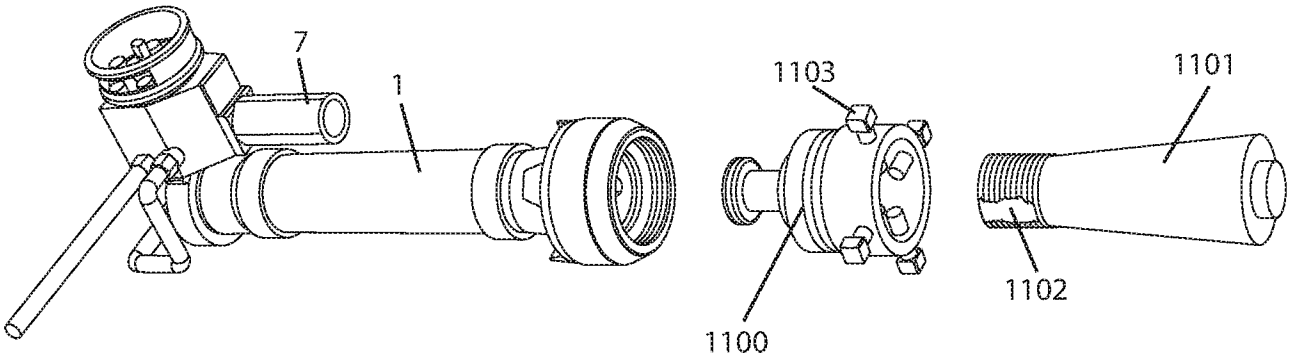
FIG. 11A is an exploded view of the FIG. 11B embodiment.
Figure 11B:
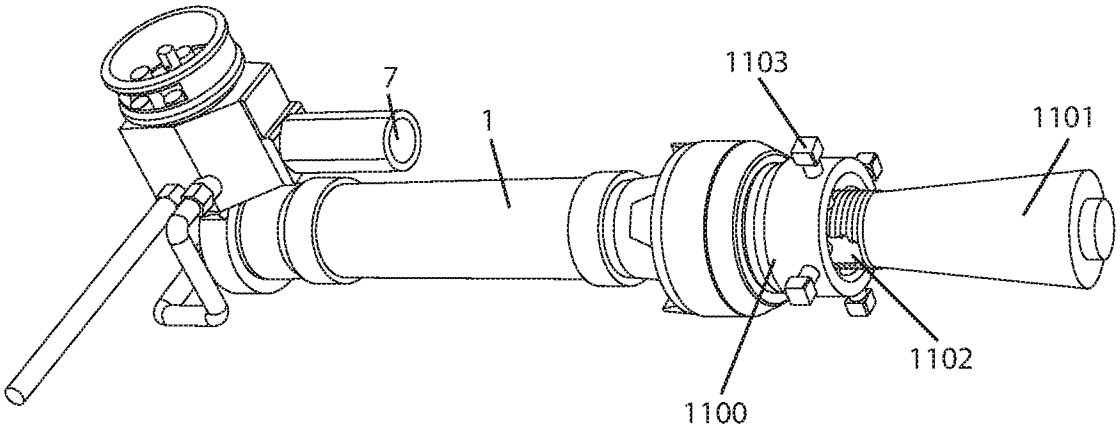
FIG. 11B is a top perspective view of a mounting collar attachment to a battered wrist pin end.

Referring next to FIGS. 11A, 11B a universal clamp 1100 is shown to grasp a wrist pin 1101 having damaged threads 1102. The universal clamp 1100 threads into the air cannon 1. Setting bolts 1103 are tightened around the damaged threads 1102. The piston hits the head 1104 of the universal clamps 1100, and the shock is transmitted to the damaged wrist pin 1101, via the setting bolts 1103.

Figure 12A:
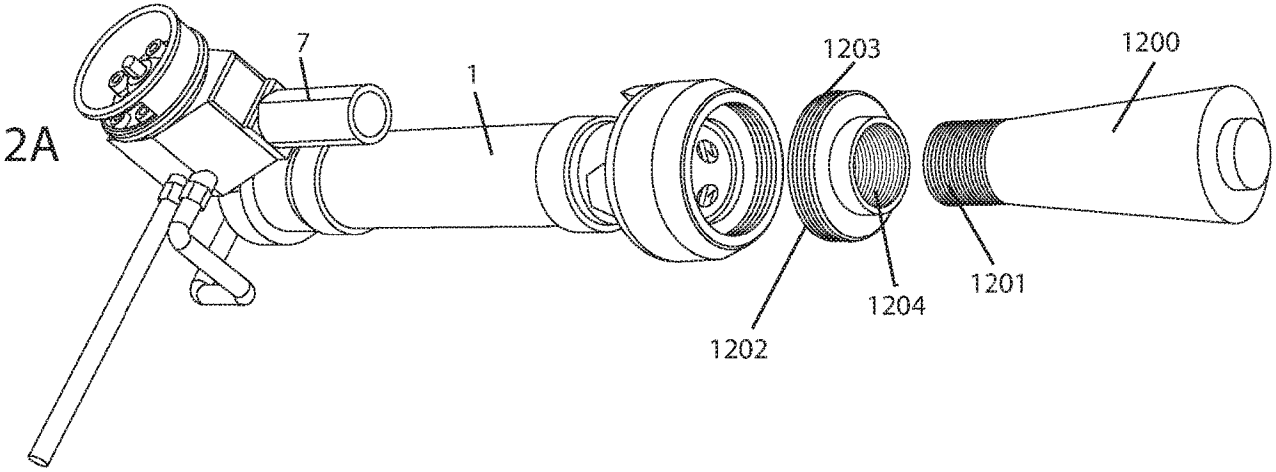
FIG. 12A is an exploded view of the FIG. 12B embodiment.
Figure 12B:
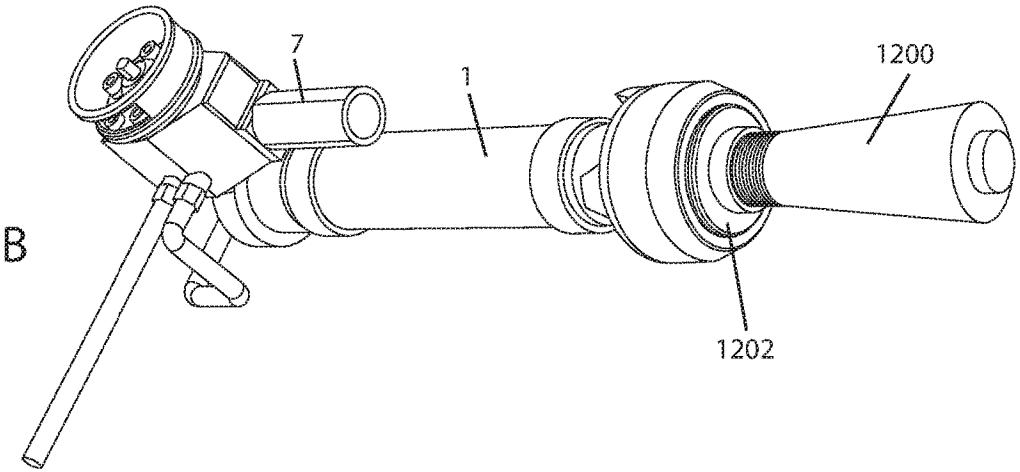
FIG. 12B is a top perspective view of a deck mount extended piston embodiment.

Referring next to FIG. 12A, 12B a wrist pin 1200 with usable threads 1201 is shown. A pin holder 1202 threads onto threads 1201. The outer threads 1203 of pin holder 1202 thread into the air cannon 1. A variety of pin holders are made with varying mating threads 1204 (and mating thread diameters) to accommodate many models of wrist pins in the field.

Figure 13A:
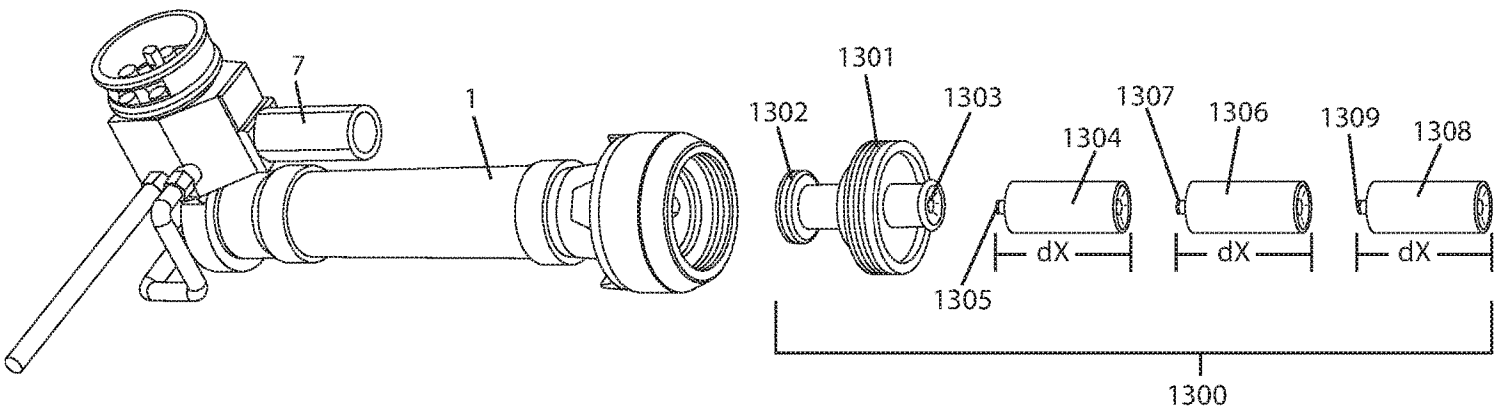
FIG. 13A is partially exploded view of an extended piston embodiment.
Figure 13B:
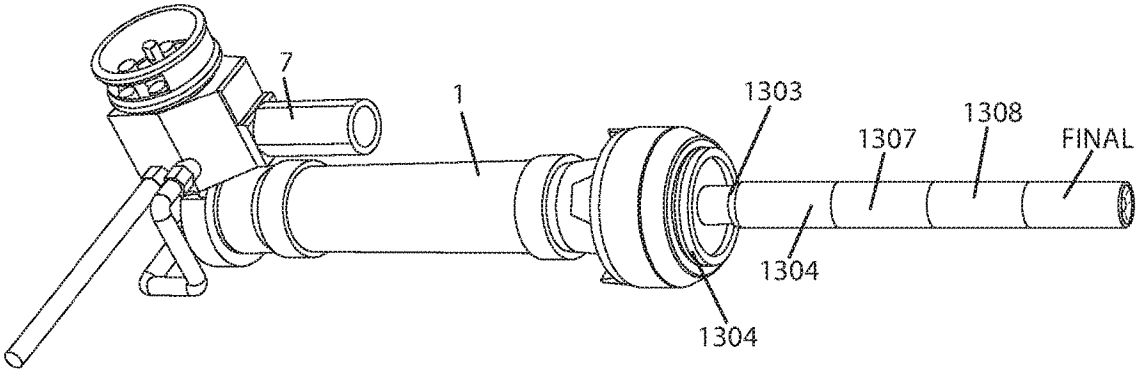
FIG. 13B is a perspective view of the extended piston embodiment assembled.

Referring next to FIGS. 13A, 13B a piston extension kit 1300 is shown which is generally used in conjunction with the tail bearing pin removal stand shown in FIG. 7B. The cannon adapter 1301 threads into the air cannon 1. The piston hits head 1302. The distal end 1303 of the cannon adapter 1301 receives a first piston extender 1304 via a locking pin 1305. The first piston extender 1304 is used to drive a stuck tail bearing its length dx down the channel. Then a second piston extender 1306 is affixed to the first piston extender 1304 via locking pin 1307. Again the stuck tail bearing is driven down its channel another distance dx. Finally a third (or more as shown by piston extender FINAL) piston extender 1308 is affixed to the second piston extender via locking pin 1309, and the stuck tail bearing is freed.

Figure 14:
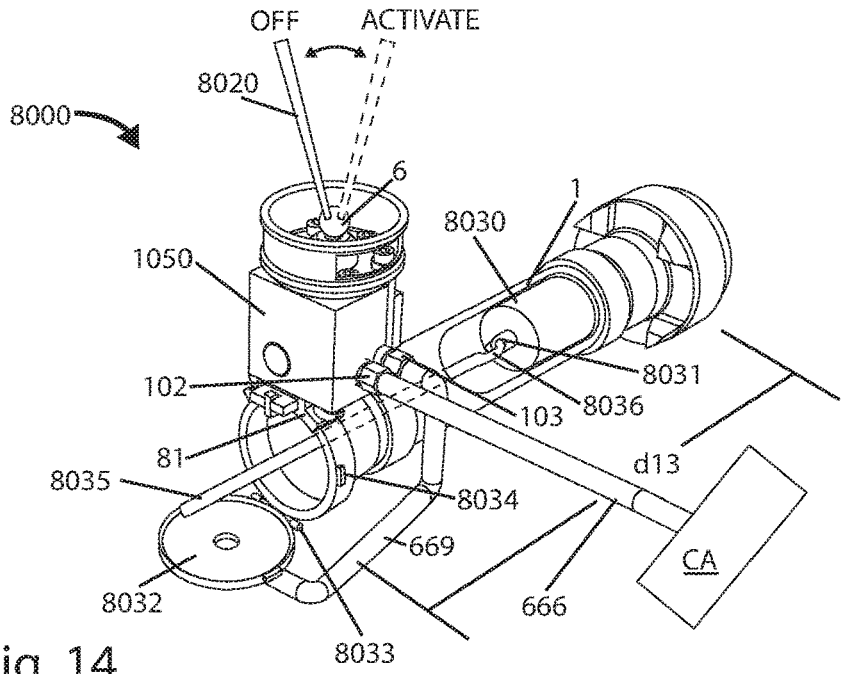
FIG. 14 is a partial cutaway view of a manual return air cannon.

Referring next to FIG. 14 a manual return air cannon 8000 uses the same compressed air CA. A simplified valve manifold 1050 has only an off position with the handle 8020, or an activate position to fire the piston 8030. The piston 8030 has a retrieval loop 8031. After firing the user opens the end cap 8032 using the hinge 8033. Then the user places a stick 8035 that has a hook 8036 to fish onto the loop 8031 and pull the piston 8030 back to the end cap 8032. Then the user closes the end cap 8032 and locks it closed using lock 8034. The valve manifold 1050 may optionally be remote as shown in FIG. 9.

Figure 15:
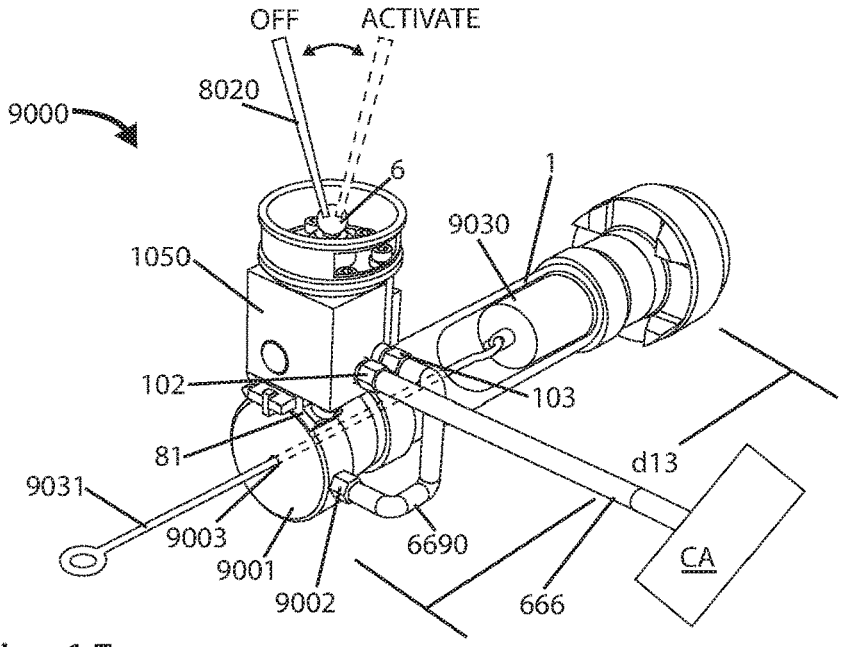
FIG. 15 is a partial cutaway view of a manual wire return embodiment.

Referring next to FIG. 15 a manual return air cannon 9000 uses the same compressed air CA. A simplified valve manifold 1050 has only an off position with handle 8020, or an activate position to fire the piston 9030. A retrieval wire 9031 is attached to piston 9030. A hole 9003 in the end cap 9001 permits the retrieval wire 9031 to slide back and forth with minimal air leakage. The end cap 9001 has a side entrance port 9002 for the control air. The hose 6690 connects to the side of the end cap 9001. After firing the user pulls the retrieval wire 9031 to return the piston 9030 back to the end cap 9001. The valve manifold 1050 may optionally be remote as shown in FIG. 9.

While a number of exemplifying features and embodiments have been discussed above, those of skill in the art will recognize certain modifications, permutations, additions and subcombinations thereof. No limitation with respect to the specific embodiments disclosed herein is intended or should be inferred.

I claim:

1. An air cannon comprising:
- a cannon barrel having a distal end for coupling to a wrist pin;
- said cannon barrel having a control end with a cannon end cap having a hole into said cannon barrel;
- a plunger mounted inside said cannon barrel;
- a multi-position valve assembly having a removable mount on said control end;
- said multi-position valve assembly having an air inlet and an air outlet; and
- a hose connecting said air outlet to said hole;
- wherein said multi-position valve assembly comprises (i) a neutral position that precludes compressed air from entering said air inlet, (ii) a shoot position to direct said compressed air from said air inlet to said hole, and (iii) a retract position;
- wherein said multi-position valve assembly is removed from said cannon barrel to provide a remote controller for said air cannon.

2. The air cannon of claim 1, wherein said retract position comprises an air inlet diverter means that functions to create a vacuum at said hole to retract said plunger back to said control end.

3. The air cannon of claim 1, wherein said plunger has a symmetrical design along a longitudinal axis.

4. The air cannon of claim 1, wherein a length of said cannon barrel is about twenty five inches, and wherein said multi-position valve assembly does not extend beyond said cannon end cap.

5. The air cannon of claim 1, wherein said cannon barrel comprises a segmented construction to provide a variety of cannon barrel lengths.

6. An air cannon comprising:
- a cannon barrel having a distal end for coupling to a wrist pin;
- said cannon barrel having a control end with a cannon end cap having a hole into said cannon barrel;
- a plunger mounted inside said cannon barrel;
- a multi-position valve assembly having a removable mount on said control end;
- said multi-position valve assembly having an air inlet and an air outlet; and
- a hose connecting said air outlet to said hole;
- wherein said multi-position valve assembly comprises (i) a neutral position that precludes compressed air from entering said air inlet, (ii) a shoot position to direct said compressed air from said air inlet to said hole, and (iii) a retract position;

wherein said removable mount comprises a bridge on said cannon end cap that receives a latch on said multi-position valve assembly, said latch having a swivel pin to attach and detach said multi-position valve assembly.

7. The air cannon of claim 6, wherein said retract position comprises an air inlet diverter means that functions to create a vacuum at said hole to retract said plunger back to said control end.

8. The air cannon of claim 6, wherein said plunger has a symmetrical design along a longitudinal axis.

9. The air cannon of claim 6, wherein a length of said cannon barrel is about twenty five inches, and wherein said multi-position valve assembly does not extend beyond said cannon end cap.

10. The air cannon of claim 6, wherein said cannon barrel comprises a segmented construction to provide a variety of cannon barrel lengths.

11. An air cannon comprising:

a cannon barrel having a distal end for coupling to a wrist pin;

said cannon barrel having a control end with a cannon end cap having a hole into said cannon barrel;

a plunger mounted inside said cannon barrel, said plunger comprising:

a solid steel impact end extending about a quarter inch beyond a first end of said plunger, said impact end is about a quarter inch narrower than a body of said plunger;

a trio of soft bearings about an inch from said impact end;

a plurality of air exhaust relief ports extending under said trio of soft bearings;

a left of center and right of center rubber snap sealer, each embedded in a circumferential slot;

a trio of soft bearings about an inch from a valve end of said plunger, said valve end being a mirror image of said impact end;

a multi-position valve assembly having a removable mount on said control end;

said multi-position valve assembly having an air inlet and an air outlet; and a hose connecting said air outlet to said hole;

wherein said multi-position valve assembly comprises (i) a neutral position that precludes compressed air from entering said air inlet, (ii) a shoot position to direct said compressed air from said air inlet to said hole, and (iii) a retract position.

12. The air cannon of claim 11, wherein said retract position comprises an air inlet diverter means that functions to create a vacuum at said hole to retract said plunger back to said control end.

13. The air cannon of claim 11, wherein said plunger has a symmetrical design along a longitudinal axis.

14. The air cannon of claim 11, wherein a length of said cannon barrel is about twenty five inches, and wherein said multi-position valve assembly does not extend beyond said cannon end cap.

15. The air cannon of claim 11, wherein said cannon barrel comprises a segmented construction to provide a variety of cannon barrel lengths.

16. An air cannon comprising:

a cannon barrel having a distal end comprising an adapter threaded thereto, said adapter having a collar with set screw bolts to fasten onto an exposed end of a wrist pin;

said cannon barrel having a control end with a cannon end cap having a hole into said cannon barrel;

a plunger mounted inside said cannon barrel;

a multi-position valve assembly having a removable mount on said control end;

said multi-position valve assembly having an air inlet and an air outlet; and a hose connecting said air outlet to said hole;

wherein said multi-position valve assembly comprises (i) a neutral position that precludes compressed air from entering said air inlet, (ii) a shoot position to direct said compressed air from said air inlet to said hole, and (iii) a retract position.

17. The air cannon of claim 16, wherein said retract position comprises an air inlet diverter means that functions to create a vacuum at said hole to retract said plunger back to said control end.

18. The air cannon of claim 16, wherein said plunger has a symmetrical design along a longitudinal axis.

19. The air cannon of claim 16, wherein a length of said cannon barrel is about twenty five inches, and wherein said multi-position valve assembly does not extend beyond said cannon end cap.

20. The air cannon of claim 16, wherein said cannon barrel comprises a segmented construction to provide a variety of cannon barrel lengths.

21. An air cannon comprising:

a cannon barrel having a distal end for impacting a workpiece with a plunger and a proximal end for receiving a control airstream to move said plunger;

a valve assembly having an inlet in an aspirator body to receive said control airstream;

said aspirator having an outlet port connected to a hole in a cannon end cap at said proximal end to provide said control airstream;

said aspirator having an internal pair of inlet ports connected together and an internal pair of outlet ports connected together;

a four port rotary control plate mounted over said internal pairs of inlet ports and said internal pair of outlet ports;

said four port rotary control plate further comprising a control shaft;

said four port rotary control plate having (i) a neutral position that blocks compressed air, (ii) an active position to divert said compressed air into said hole, thereby firing said plunger to said distal end, and (iii) a retract position that directs said compressed air across a vortex tube, thereby creating a vacuum at a base of an aspirator nozzle;

wherein said vacuum communicates via said outlet port with said proximal end, thereby causing said plunger to retract to said proximal end; and wherein said valve assembly has a removable connection to said proximal end.

22. The air cannon of claim 21, wherein said valve assembly is mounted to a side of said cannon barrel, and said outlet port is connected by a hose to said hole in said cannon end cap.

23. The air cannon of claim 22, wherein said cannon end cap further comprises a mounting bridge which receives a locking peg of said valve assembly to secure said valve assembly to said proximal end.

24. The air cannon of claim 23, wherein said locking peg further comprises a release pin that enables removal of said valve assembly from said air cannon to a remote position, thereby providing operation of said air cannon from said remote position.

* * * * *